United States Patent [19]

Johnson

[11] Patent Number: 4,872,632

[45] Date of Patent: Oct. 10, 1989

[54] ADJUSTABLE OVERHEAD HANGER WITH LOCK PULLEY

[76] Inventor: Van P. Johnson, 7722 12th NW., Seattle, Wash. 98117

[21] Appl. No.: 250,773

[22] Filed: Sep. 27, 1988

[51] Int. Cl.[4] ..... A47B 96/06

[52] U.S. Cl. ..... 248/332; 254/391

[58] Field of Search ..... 248/332, 317, 320, 323, 248/324, 327, 328, 495; 254/391, 415

[56] References Cited

U.S. PATENT DOCUMENTS

| | | | |
|---|---|---|---|
| 580,770 | 4/1897 | Cashion . | |
| 842,656 | 1/1907 | Hardsocg . | |
| 943,651 | 12/1909 | Chandler et al. . | |
| 992,969 | 5/1911 | McCanse . | |
| 1,471,454 | 10/1923 | Dolan et al. . | |
| 2,291,894 | 8/1942 | Gwinn, Jr. | 254/415 |
| 2,702,176 | 2/1955 | Dulle | 248/323 |
| 3,167,145 | 1/1965 | Mackie | 248/317 X |
| 3,518,791 | 7/1970 | Carson et al. | 47/47 |
| 3,662,992 | 5/1972 | Vittert | 254/391 |
| 3,698,676 | 10/1972 | Moore, Jr. | 248/317 |
| 3,944,186 | 3/1976 | Einhorn et al. | 254/191 |
| 4,057,211 | 11/1977 | Moore | 248/332 |
| 4,090,692 | 5/1978 | Jacobs | 254/141 |
| 4,187,996 | 2/1980 | Ehrlich | 242/107.4 |
| 4,767,101 | 8/1988 | Schweinberger | 254/391 |

FOREIGN PATENT DOCUMENTS

| | | | |
|---|---|---|---|
| 0203918 | 6/1965 | Sweden | 254/391 |
| 0061986 | 11/1912 | Switzerland | 254/415 |
| 0732197 | 5/1980 | U.S.S.R. | 254/391 |

*Primary Examiner*—Ramon O. Ramirez

*Attorney, Agent, or Firm*—Glenn D. Bellamy

[57] ABSTRACT

The disclosed apparatus (10) for suspending articles (14) from an overhead member (12) includes an elongated support member (20) attachable to the overhead member (12), first and second pulleys (22, 34) supported by the support member (20), an abutment (28) radially spaced from the first pulley (22), and a pivoting lock member (30) coaxial with and operably independent from the first pulley (22). A cord (32) passes over the first pulley (22) inwardly of the abutment (28) and extends further over the second pulley (34). One end of the cord (42) which is proximal to the second pulley (34), is attachable to an article (14) to be supported from the cord (32, 42). The cord (32) is normally freely movable over the pulleys (22, 34) to allow the height of a suspended article (14) to be adjusted, but may be restricted from movement in one direction by clamping engagement of the cord (32) between the lock member (30) and the abutment (28), thereby fixing the height at which an article (14) is suspended.

16 Claims, 4 Drawing Sheets

132
20
32
38
36
34
42
18
130
122
48
22
26
24
30
46
44
44'
40
88
28
120
128
16

ADJUSTABLE OVERHEAD HANGER WITH LOCK PULLEY

TECHNICAL FIELD

This invention relates to an overhead hanger assembly, attachable to a level or sloped ceiling, from which articles, such as potted plants or the like, may be adjustably suspended.

BACKGROUND ART

The general concept of suspending objects from a ceiling by using a cord looped over a pulley is well known. Likewise, the general concept of a locking pulley which may selectively restrict movement of a cord in one direction is well known.

U.S. Pat. No. 2,702,176, issued Feb. 15, 1955, to William J. Dulle discloses a pulley assembly attached to a ceiling-mounted track for raising, lowering and suspending articles therefrom. Links of a chain are engaged in a keyhole-shaped notch to secure articles in a suspended positon. U.S. Pat. No. 3,944,186, issued Mar. 16, 1976, to Ruediger Einhorn et al. discloses a ceiling-mounted locking pulley assembly for suspending plants or other articles overhead. It shows a pulley wheel having a circumferential groove and one or more locking grooves. Each locking groove is helically formed on the pulley wheel extending from the circumferential groove to one side thereof and gradually diminishing in depth as the distance from the groove increases U.S. Pat. No. 4,187,996, issued Feb. 12, 1980, to Sol Ehrlich, discloses a spring-wound spool apparatus for suspending potted plants or similar articles overhead for a ceiling. Each of these patents should be carefully considered for the purpose of putting the present invention into proper perspective relative to the prior art.

DISCLOSURE OF THE INVENTION

The present invention provides a new and useful overhead hanger apparatus from which articles may be raised, lowered or adjustably suspended overhead from a horizontal or sloped ceiling. The invention provides one or more locking pulleys in an assembly which may be adjusted in attitude to accommodate varying ceiling angles.

In basic form the overhead hanger of the present invention includes an elongated support member attachable to an overhead member, first and second pulleys supported by the support member, an abutment radially spaced from the first pulley, and a pivoting lock member which is co-axial with and operably independent from the first pulley. A suspension cord passes over the first pulley inwardly of the abutment and extends over the second pulley. An article to be suspended overhead may be attached to an end of the cord which is proximal to the second pulley. The cord is normally freely movable over the pulleys to allow the height of a suspended article to be adjusted, but may be restricted from movement in one direction by clamping engagement of the cord between the lock member and the abutment, thereby fixing the height at which an article is suspended.

According to another aspect of the invention, the support member may be mounted to either a horizontal or sloping overhead member. The abutment may be circumferentially positionable about the central axis of the first pulley so that the attitude of the support member relative to horizontal is adjustable independent of the attitude of the abutment relative to the first pulley.

Another aspect of the invention is that the pulleys may be slidably positionable along the length of the support member. The support member may be in the form of a channel, and a securing means, such as a set screw, may be used to secure the position of the pulleys along the length of the channel.

Other aspects, features and combinations of the present invention will become apparent from the following drawings and description of a preferred embodiment of the invention.

BRIEF DESCRIPTION OF THE DRAWING

Referring to the several figures of the drawing, wherein like numerals refer to like parts throughout, and wherein.

BEST MODE FOR CARRYING OUT THE INVENTION

Figure 1:
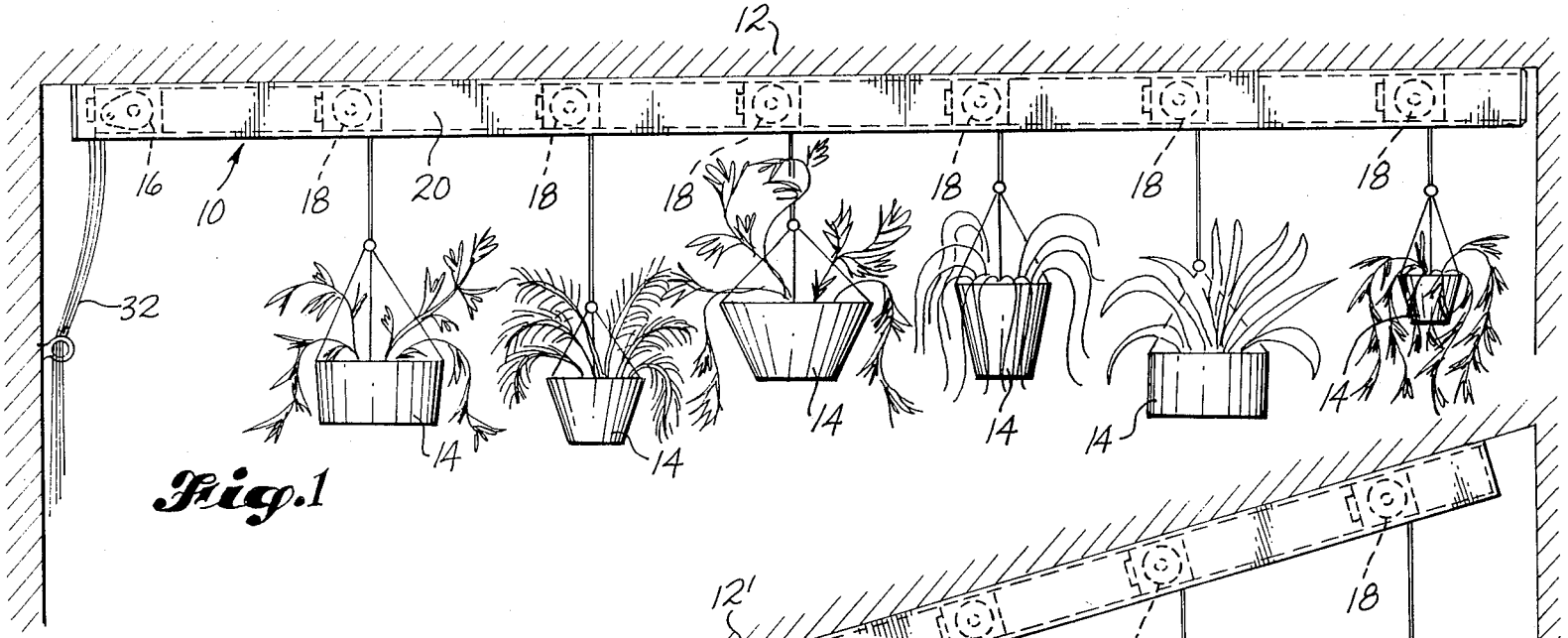
FIG. 1 is a side view of the preferred embodiment of the invention shown mounted to a horizontal ceiling and suspending potted plants therefrom.
Figure 2:
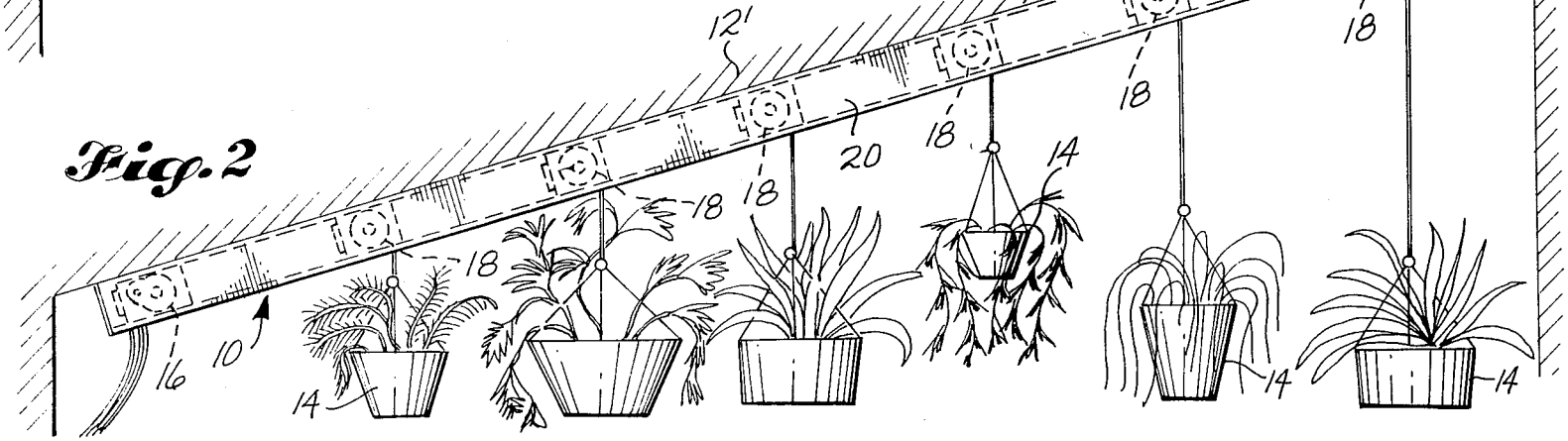
FIG. 2 is a side view of the preferred embodiment of the invention mounted to a sloping ceiling.

Referring again to the several figures of the drawing, and first to FIGS. 1 and 2, the illustrated preferred embodiment 10 is shown attached to a ceiling 12, 12' and supporting a plurality of potted plants 14. In FIG. 1 the illustrated embodiment 10 is shown mounted to a horizontal ceiling 12, and in FIG. 2 the preferred embodiment 10 is shown mounted to a sloping ceiling 12'. The illustrated embodiment 10 is shown having a single locking pulley assembly 16 and separate freely-rotating pulley assemblies 18, each associated with one of the suspended plants 14.

Figures 3, 4, 5:
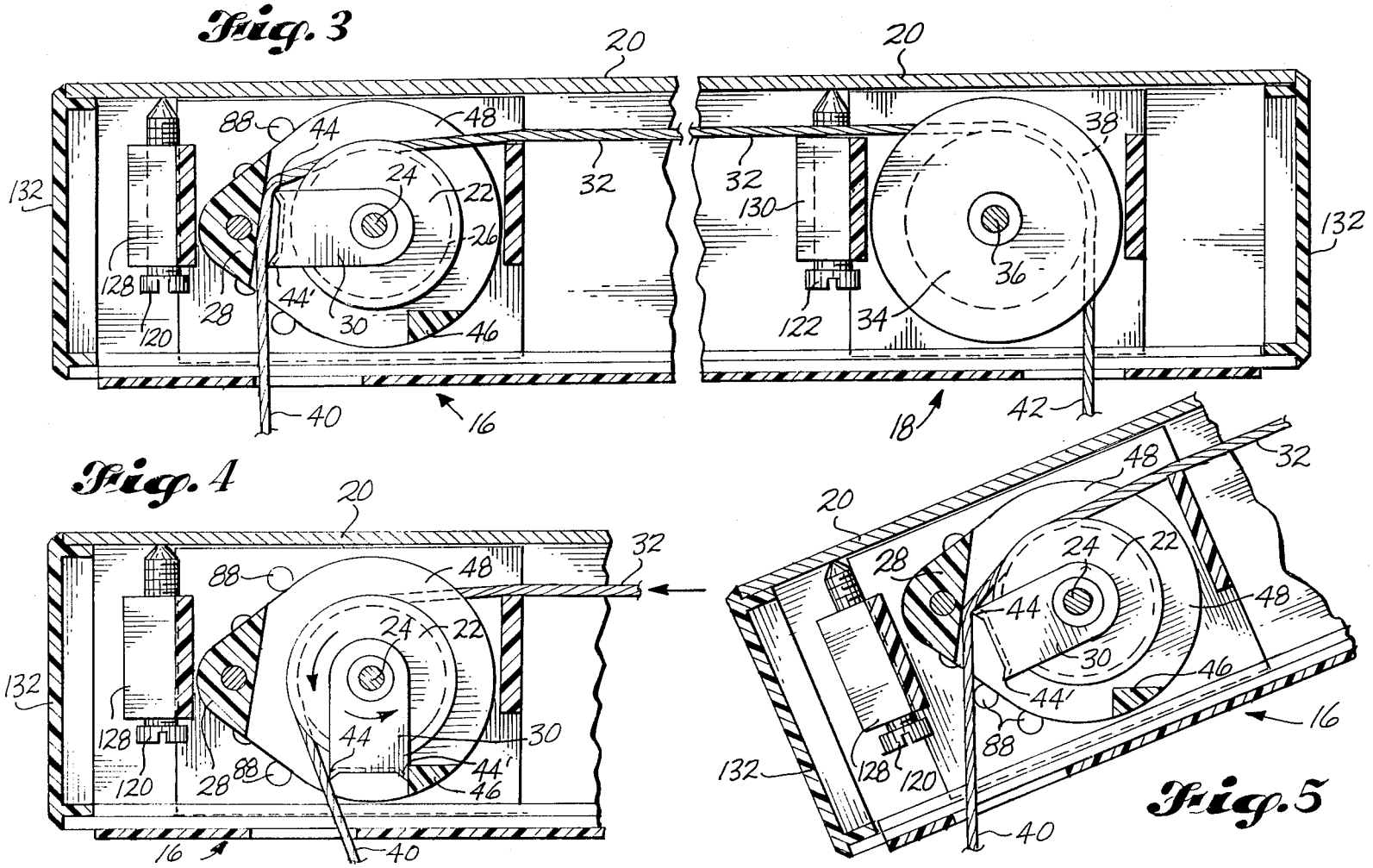
FIG. 3 is a fragmentary cross-sectional view of the preferred embodiment of the invention.
FIG. 4 is a fragmentary cross-sectional view of the preferred embodiment of a locking pulley assembly.
FIG. 5 is a fragmentary cross-sectional view similar to FIG. 4 except with the assembly shown mounted at an angle to horizontal.

Essential parts of a basic embodiment are shown in FIG. 3. The preferred embodiment includes a support channel 20 which is mountable to an overhead ceiling 12, 12'. Supported by the channel 20 is a locking pulley assembly 16 and one or more freely-rotating pulley assemblies 18. The locking pulley assembly 16 includes a pulley wheel 22 which freely pivots on a central axle 24 and has a circumferential cord-carrying groove 26. Radially spaced from the pulley wheel 22 is an abutment 28. A pivoting lock member 30 is co-axial with, but operably independent from, the pulley 22. A cord 32 is normally freely movable over the pulley 22, but may be restricted from movement in one direction by engagement of the cord 32 between the lock member 30 and the abutment 28, as shown in FIG. 3.

In this preferred embodiment, a second pulley 34 is supported by the channel 20 at a position radially spaced from the first pulley 22. The second pulley 34 is freely rotatable about an axle 36 and has a circumferential cordengaging groove 38. The first and second pulleys 22, 34 are substantially colinear or co-tangential such that the cord 32 may be engaged within each circumferential groove 26, 38 and extend substantially tangentially from one pulley 22, to the other pulley 34. In use, the cord 32 may pass upwardly from a first end portion 40 over the first pulley 22, extend longitudinally along the channel 20 to the second pulley 34, and, after passing over the second pulley 34, extend downwardly to a second end portion 42. Objects to be supported by the overhead hanger are attached to the second end portion 42 of the cord 32. The first end portion 40 of the cord 32 is used for manipulating the cord 32 and adjusting the relative height of an object, such as a potted plant 14, suspended at the second end portion 42.

The pivoting lock member 30 shown in the illustrated embodiment has a tooth portion 44 which is capable of gently biting the surface of the cord 32. The weight of an object suspended at the second end portion 42 of the cord 32 will cause the pivoting lock member 30 to remain in a position which engages the cord 32 between the tooth portion 44 and the abutment 28, as shown in FIGS. 3 and 5. The pivoting lock member 30 may include a second tooth portion 44' which is spaced circumferentially from the first tooth portion 44. In this manner, the pivoting lock member 30 may assume a positive lock position, as shown in FIG. 3, wherein both tooth portions 44, 44' engage the cord 32 against the abutment 28. In this position, the cord 32 is restricted from movement in a direction which would cause the first end portion 40 to move upwardly and the second end portion 42 to move downwardly. The weight of the suspended object causes the cord 32 to be put into tension between the point at which the tooth portion 44 engages the cord 32, and the point at which the object is attached to the cord 32 at the second end portion 42. The engaging position of the pivoting lock member 30, as shown in FIG. 5, is a position of preliminary engagement which would proceed the positive lock position of the pivoting lock member 30, as shown in FIG. 3.

Downward movement of the first end portion 40 of the cord 32 will release engagement of the cord 32 from between the pivoting lock member 30 and the abutment 28, as shown in FIG. 4. Because the pivoting lock member 30 is operably independent from the pulley 22, it will normally gravitate to a downward position, as shown in FIG. 4, and allow free movement of the cord 32 over the pulley 22.

After the cord 32 has been adjusted to a desired orientation, the first end portion 40 of the cord 32 may be moved to catch the tooth portion 44 of the pivoting lock member 30. A stop member 46 prevents further rotation of the pivoting lock member 30 so that pressure of the cord 32 against the tooth portion 44 will cause the pivoting lock member 30 to engage or grip the cord 32. In preferred form, the stop member 46 limits rotation of the pivoting lock member 30 to less than 90°, or in any case, to no further than the normal gravitational resting point, as shown in FIG. 4. Upward movement of the first end portion 40 of the cord 32 while it is against the tooth portion 44 will lift the pivoting lock member 30 upwardly until the cord 32 is clamped between the tooth portion 44 and the abutment 28, as shown in FIG. 5. Continued upward movement of the first end portion 40 of the cord 32 will allow the pivoting lock member 30 to move into the positive lock position, as shown in FIG. 3. The gravitational force exerted on the cord 32 by a suspended object will cause the cord 32 to remain so engaged until such time as this force is overcome by a downward pull upon the first end portion 40.

Because the locking pulley assembly relies in part on gravity to position the pivoting lock member 30, it is important that the position of the abutment 28 and the stop member 46 be consistently oriented relative to horizontal. The abutment 28 and stop member 46 must remain at a fixed orientation to the pulley 22, relative to horizontal, regardless of the attitude of the support channel 20. In the illustrated embodiment, the abutment 28 and stop member 46 are attached to a wall portion 48 which may be pivoted on the axle 24. FIG. 5 ilustrates the manner in which the channel 20 may be angled to correspond with the slope of a ceieling 12', and wherein the abutment 28 and stop member 46 may be adjusted about the axle 24 relative to the channel 20. The abutment 28, stop member 46, and wall portion 48 are fixed in orientation relative to the axle 24 in a manner which is further described below.

Figure 6:
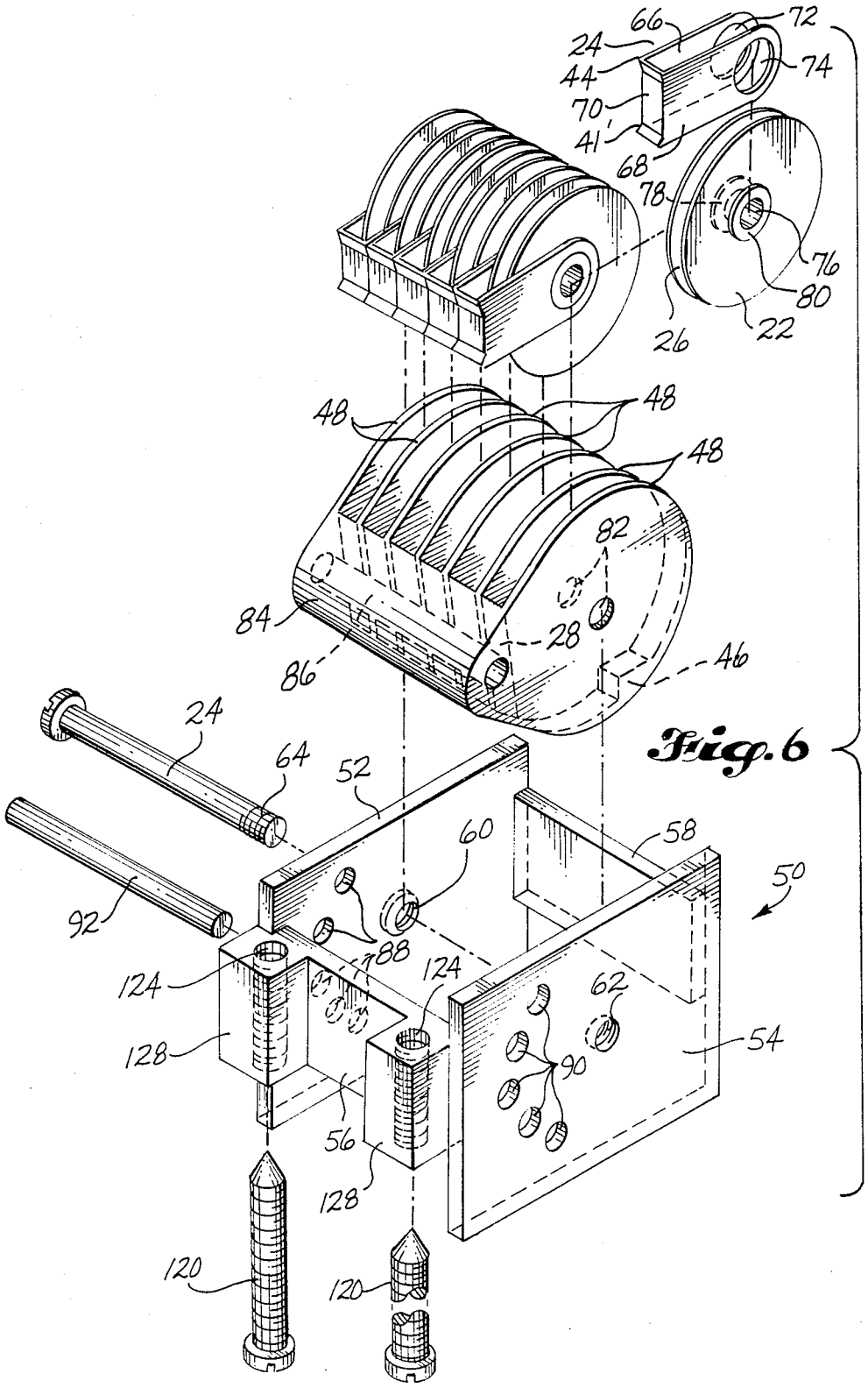
FIG. 6 is an exploded pictorial view of a locking, adjustable pulley assembly.

Referring now to FIG. 6, the locking pulley assembly is supported within a block 50 which includes a pair of sidewall portions 52, 54 interconnected by web portions 56, 58. Opposed openings 60, 62 are formed in the sidewall portions 52, 54 of the block 50 for supporting the axle 24. The axle 24 may include a threaded portion 64 for engagement within one or both of the opposite openings 60, 62. The block 50 may support a plurality of coaxial locking pulley assemblies, as shown in FIG. 6. In this embodiment, six such assemblies are assembled together on a single axle 24 and the wall portion 48 which connects each abutment 28 with each stop member 46 axially separates each associated pulley 22 and pivoting lock member 24. An abutment 28 may be formed separately for each locking pulley assembly, or, as in the preferred embodiment, may be formed integrally.

In the illustrated embodiment, the pivoting lock member includes substantially parallel radially extending side portions 66, 68, interconnected at the outward end by a web portion 70. Opposite openings 72, 74 are formed in the side portions 66, 68 and are larger in diameter than the axle 24 on which the pulley 22 is mounted. A central opening 76 formed axially through the pulley wheel 22 is surrounded on each side by an annular shoulder portion 78, 80 which acts as a bearing or axle for the pivoting lock member 42, and is sized to correspond with the openings 72, 74. This provides a relatively frictionless bearing for the pivoting lock member 24 and allows it to pivot independent of the pulley wheel 22. A tooth portion 44, 44' is formed on each tangentially opposed edge of the pivoting lock member 24.

Openings 82 are formed axially through each wall portion 48 so that the wall portions 48 in conjunction with the abutments 28 and stop members 46 may be rotated on the axle 24 co-axially with the pulley wheels 22 and pivoting lock members 24. An interconnecting extension portion 84 may be provided with a transverse opening 86 which is substantially parallel to and spaced from axial openings 82.

A series of openings 88, 90 is provided in each sidewall portion 52, 54 of the block 50. This series of openings 88, 90 are spaced around opposite openings 60, 62 at an equal radius therefrom. The series of openings 88, 90 are spaced the same radius from openings 60, 62 as the transverse opening 86 is spaced from the axial openings 82. In this manner, the flange portions 48, along with the abutments 28 and stop members 46, may pivot about the axle 24 and may be fixed in position by insertion of a stop pin 92 through transverse opening 86 and a pair of corresponding openings 88, 90 in the sidewall portions 52, 54 of the block 50. The channel 20 may extend away from the locking pulley assembly 16 at an inclination or declination while maintaining the abutment 28 and stop member 46 at a fixed orientation relative to horizontal.

Figure 7:
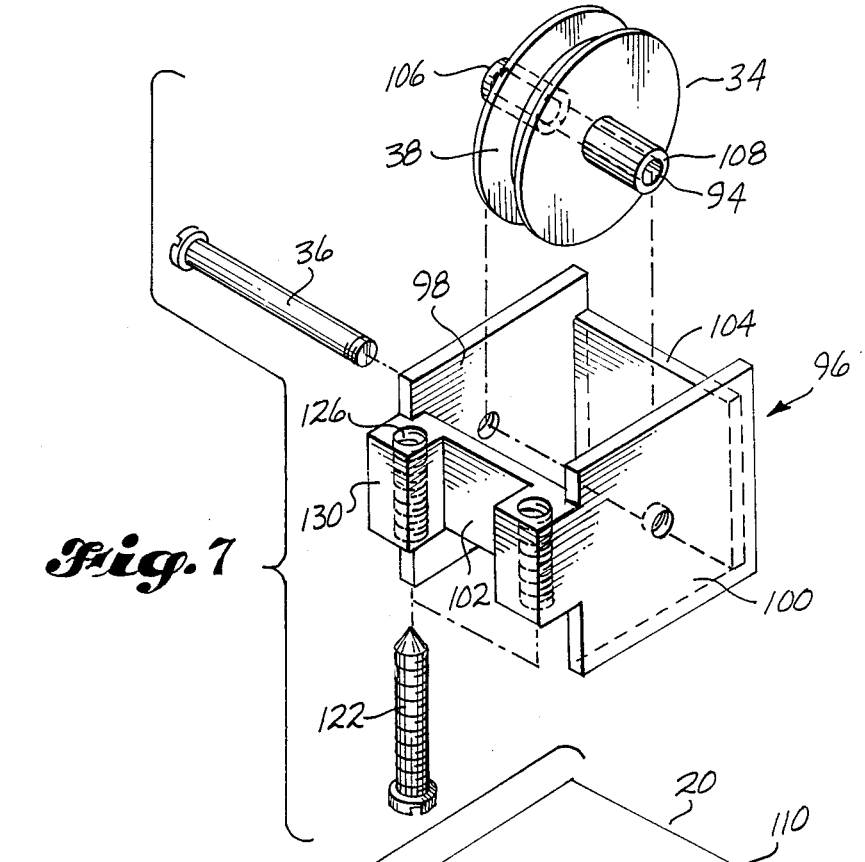
FIG. 7 is an exploded pictorial view of a freely-rotating pulley assembly.
Figure 8:
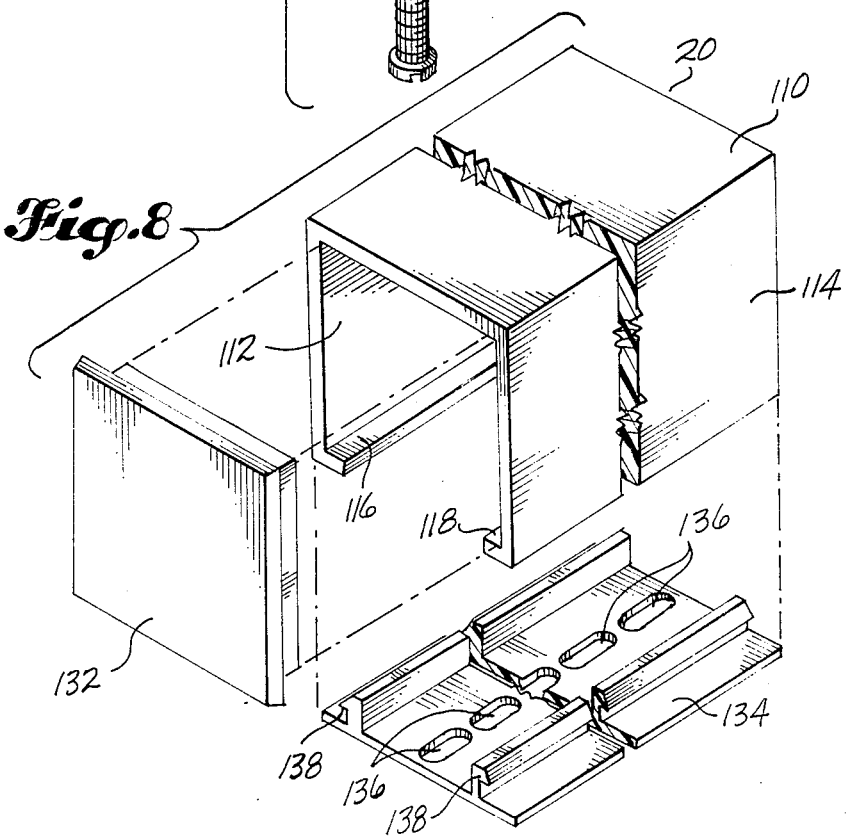
FIG. 8 is a fragmentary exploded pictorial view of a support channel with end cap and cover plate.

Shown in FIG. 7 is a preferred embodiment of a freelyrotating pulley assembly 18. Therein, a pulley wheel 34, having a central opening 94, is mounted on an axle 36. The axle 36 is supported at each end by a block 96. The block 96 includes opposite sidewalls 98, 100 interconnected by web portions 102, 104. In preferred form, the sidewalls 98, 100 of block 96 are spaced apart the same distance as sidewalls 52, 54 of block 50. Because the freely-rotating pulley assembly typically includes only one pulley wheel 34, and each locking pulley assembly 16 typically includes a plurality of pulleys 22. Spacing shoulders 106, 108 on each side of the pulley wheel 34 maintain its centered axial position within the block 96. Because of the distance between each freely-rotating pulley wheel 34 and its corresponding locking pulley wheel 22, the tangential misalignment created by having each freely-rotating pulley wheel 34 centered within its block 96 is neglibible. Such an alignment is considered to be substantially colinear or co-tangential such that the cord 32 may be engaged within each circumferential groove 26, 38 without substantial risk of disengagement.

The support channel 20 may be of any necessary length to provide the desired spacing between each of a plurality of freely-rotating assemblies 18, or between locking pulley assembly 16 and one or more freely-rotating pulley assemblies 18.

In preferred form, the support channel 20 includes a top panel 110, sidewall portions 112, 114 which are substantially parallel and depend for opposite edges of the top panel 110, and a pair of inwardly extending flange portions 116, 118 which extend from the sidewalls 112, 114 and define an open space therebetween.

The inwardly extending flanges 116, 118 provide a ledge on which sidewall portions 52, 54, 98, 100 of the pulley blocks 50, 96 may be supported. Each of the pulley blocks 50, 96 may be anchored along a longitudinal position within the support panel 20 by means of set screws 120, 122. The set screws 120, 122 may be mounted through an internally threaded bore 124, 126 of an outward extension portion 128, 130 of each pulley block 50, 96. The set screw 120, 122 may be adjusted to bear against the top panel 110 of the support channel 20, frictionally engaging the block 50, 96 between the top panel 110 and the flange portions 116, 118. Decorative end caps 132 may be provided at one or both ends of the support channel 20. A bottom closure strip 134 may be provided along the length of the support channel 20 and would include openings 136 through which the cord 32 may ascend or descend. The bottom closure strip 134 may attach to the support channel 20 by provision of lip portions 138 which engage over inward edges of the inwardly extending flanges 116, 118 of the support channel 20.

The invention and its inherent advantages will be understood from the foregoing description of a typical and preferred embodiment, constituting the best mode of the invention known to the applicant at the time of filing the patent application. However, it will be apparent from the embodiment, and from the following claims, that various changes may be made in form, construction and arrangement of the parts of the device without departing from the spirit and scope of the invention. According, I do not wish to be restricted to the specific form shown, or to the specific use mentioned, except to the extent that the invention is defined in the following claims.

What is claimed is:

1. An apparatus for suspending articles from an overhead member, comprising:

an elongated support member attachable to said overhead member;

a first pulley having an axis and being supported by said support member;

an abutment radially spaced from said first pulley and having a use position fixed relative to said support member;

a second pulley supported by said support member and spaced from said first pulley, said first and second pulleys being substantially co-tangential;

a cord having two ends and passing over said first pulley radially inwardly of said abutment and further over said second pulley, the end of said cord proximal to said second pulley being attachable to an article to support said article at a height determinable by movement of said cord over said pulleys;

a pivoting lock member which pivots coaxial with and operably independent from said first pulley;

wherein said cord is normally freely movable over said pulleys, but may be restricted from movement in one direction by clamping engagement of the cord between said lock member and said abutment.

2. The apparatus of claim 1, further comprising a means for limiting the pivotal movement of said lock member to less than 90° rotation away from said abutment.

3. The apparatus of claim 1, wherein said abutment is circumferentially positionable at a fixed radius about the axis of said first pulley such that the attitude of said abutment relative to a horizontal plane intersecting the axis of said first pulley remains fixed regardless of the attitude of said support member relative to said horizontal plane.

4. The apparatus of claim 1, wherein said pulleys are slidably positionable along the length of said support member.

5. An apparatus for suspending articles from an overhead member, comprising:

an elongated support member attachable to said overhead member;

a first pulley supported by said support member;

an abutment radially spaced from said first pulley;

a second pulley supported by said support member and spaced from said first pulley, said first and second pulleys being substantially co-tangential;

a cord having two ends and passing over said first pulley inwardly of said abutment and further over said second pulley, the end of said cord proximal to said second pulley being attachable to an article to support said article at a height determinable by movement of said cord over said pulleys;

a pivoting lock member coaxial with and operably independent from said first pulley;

wherein said cord is normally freely movable over said pulleys, but may be restricted from movement in one direction by clamping engagement of the cord between said lock member and said abutment, wherein said pulleys are slideably positionable along the length of said support member, and wherein said support member is a channel, said channel including a top panel, opposite sidewalls downwardly extending from opposite edges of said top panel, and a pair of flanges, each said flange extending inwardly from a sidewall and said flanges defining an opening therebetween, wherein an open space is defined between said sidewalls and between said top panel and said flanges, and further comprising a pulley support frame sized to fit within said open space and slidably positionable therein along the length of the channel, said pulley support frame including a means for securing said support frame at a given position along said channel.

6. The apparatus of claim 5, wherein said securing means includes a set screw which may be threadedly adjusted to bear against an inner surface of said channel.

7. An apparatus for suspending articles from an overhead member, comprising:

an elongated support member attachable to said overhead member;

a first pulley supported by said support member;

an abutment radially spaced from said first pulley;

a second pulley supported by said support member and spaced from said first pulley, said first and second pulleys being substantially co-tangential;

a cord having two ends and passing over said first pulley inwardly of said abutment and further over said second pulley, the end of said cord proximal to said second pulley being attachable to an article to support said article at a height determinable by movement of said cord over said pulleys;

a pivoting lock member coaxial with and operably independent from said first pulley;

wherein said cord is normally freely movable over said pulleys, but may be restricted from movement in one direction by clamping engagement of the cord between said lock member and said abutment, wherein said support member is a channel, said channel including a top panel, opposite sidewalls downwardly extending from opposite sidewalls downwardly extending from opposite edges of said top panel, and a pair of flanges, each said flange extending inwardly from a sidewall and said flanges defining an opening therebetween, wherein an open space is defined between said sidewalls and between said top panel and said flanges, and wherein said first and second pulleys are supported within said open space of said channel.

8. The apparatus of claim 7, wherein said pulleys are slidably positionable along the length of said channel.

9. An apparatus for suspending articles overhead, comprising:

an elongated support member attachable to an overhead member;

a locking pulley assembly supported by said support member and including a plurality of coaxial first pulley wheels, an abutment radially spaced from and corresponding to each said first pulley wheel, said abutment having a use position fixed relative to said support member and a pivoting lock member associated with each said first pulley wheel, each pivoting lock member pivoting coaxial with and operably independent from its associated first pulley wheel, a plurality of second pulleys each associated with a first pulley wheel of said locking pulley assembly and supported by said support member, each of said second pulleys being radially spaced from and substantially co-tangential with its associated first pulley wheel of said locking pulley assembly;

a plurality of cords each having two ends and passing over a separate pulley wheel of said lock pulley assembly radially inwardly of said abutment and further passing over the associated one of said second pulleys, one end of said cord being proximal to said second pulley and being operable to support an article at a height determinable by movement of said cord, wherein each of said cords is normally freely movable over each of said associated pulleys but each may be restricted from movement in one direction by engagement of the cord between said associated pivoting lock member and said abutment.

10. The apparatus of claim 9, further comprising a means for limiting the pivotal movement of said lock members to less than 90° rotation away from said abutment.

11. The apparatus of claim 9, wherein said abutment is circumferentially positionable at a fixed radius about the axis of said first pulleys such that the attitude of said abutment relative to a horizontal plane intersecting the axis of said first pulleys remains fixed regardless of the attitude of said support member relative to said horizontal plane.

12. The apparatus of claim 9, wherein said second pulleys are longitudinally spaced along said elongated support member.

13. An apparatus for suspending articles overhead, comprising:

an elongated support member attachable to an overhead member;

a locking pulley assembly supported by said support member and including a plurality of coaxial first pulley wheels, an abutment radially spaced from and corresponding to each said first pulley wheel, and a pivoting lock member associated with each said first pulley wheel, each pivoting lock member being coaxial with and operably independent from its associated first pulley wheel, a plurality of second pulleys each associated with a first pulley wheel of said locking pulley assembly and supported by said support member, each of said second pulleys being radially spaced from and substantially co-tangential with its associated first pulley wheel of said locking pulley assembly;

a plurality of cords each having two ends and passing over a separate pulley wheel of said lock pulley assembly inwardly of said abutment and further passing over the associated one of said second pulleys, one end of said cord being proximal to said second pulley and being operable to support an article at a height determinable by movement of said cord, wherein each of said cords is normally freely movable over each of said associated pulleys but each may be restricted from movement in one direction by engagement of the cord between said associated pivoting lock member and said abutment, wherein said second pulleys are longitudinally spaced along said elongated support member, and wherein said support member is a channel, said channel including a top panel, opposite sidewalls downwardly extending from opposite edges of said top panel, and a pair of flanges, each said flange extending inwardly from a sidewall and said flanges defining an opening therebetween, wherein an open space is defined between said sidewalls and between said top panel and said flanges, and further comprising a pulley support frame corresponding to each said pulley sized to fit within said open space and slidably positionable therein along the length of the channel, each said pulley support frame including a means for securing said support frame at a given position along said channel.

14. The apparatus of claim 13, wherein said securing means includes a set screw which may be threadedly adjusted to bear against an inner surface of said channel.

15. An apparatus for suspending articles overhead, comprising:

an elongated support member attachable to an overhead member;

a locking pulley assembly supported by said support member and including a plurality of coaxial first pulley wheels, an abutment radially spaced from and corresponding to each said first pulley wheel, and a pivoting lock member associated with each said first pulley wheel, each pivoting lock member being coaxial with and operably independent from its associated first pulley wheel, a plurality of second pulleys each associated with a first pulley wheel of said locking pulley assembly and suported by said support member, each of said second pulleys being radially spaced from and substantially co-tangential with its associated first pulley wheel of said locking pulley assembly;

a plurality of cords each having two ends and passing over a separate pulley wheel of said lock pulley assembly inwardly of said abutment and further passing over the associated one of said second pulleys, one end of said cord being proximal to said second pulley and being operable to support an article at a height determinable by movement of said cord, wherein each of said cords is normally freely movable over each of said associated pulleys but each may be restricted from movement in one direction by engagement of the cord between said associated pivoting lock member and said abutment, wherein said second pulleys are longitudinally spaced along said elongated support member, and wherein said support member is a channel, said channel including a top, a pair of substantially parallel side portions downwardly extending from said top, and a pair of flanges, each said flange extending inwardly from a side portion and said flanges defining an opening therebetween, wherein an open space is defined between said side portions and between said top and said flanges, and wherein said locking pulley assembly and said second pulleys are supported substantially within said open space of said channel.

16. The apparatus of claim 15, wherein said pulleys are slidably positionable along the length of said channel.

* * * * *

UNITED STATES PATENT AND TRADEMARK OFFICE

CERTIFICATE OF CORRECTION

PATENT NO. : 4,872,632

DATED : October 10, 1989

INVENTOR(S) : Van P. Johnson

It is certified that error appears in the above-identified patent and that said Letters Patent is hereby corrected as shown below:

In column 1, line 31, there should be a period after "increases".
Column 1, line 34, "for' should be -- from --.
Column 3, line 1, "cordengaging" should be -- cord-engaging --.
Column 4, line 12, "ilustrates" should be -- illustrates --.
Column 4, line 14, "ceieling" should be -- ceiling --.
Column 4, line 46, "member 42" should be -- member 24 --
Column 5, line 10, "freelyrotating" should be -- freely-rotating --.
Column 5, line 26, "neglibible" should be -- negligible --.
Claim 7, column 7, delete line 44 "wardly extending from opposite sidewalls down-".
Claim 15, column 9, line 31, "suported" should be -- supported --.

Signed and Sealed this

Twenty-third Day of October, 1990

*Attest:*

HARRY F. MANBECK, JR.

*Attesting Officer*

*Commissioner of Patents and Trademarks*